US006126164A

United States Patent [19]

Rennick et al.

[11] Patent Number: 6,126,164

[45] Date of Patent: Oct. 3, 2000

[54] BAIL ASSEMBLY

[75] Inventors: David Erwin Rennick, Georgetown; William Joseph Thornhill; John Wayne Gassett, both of Lexington, all of Ky.

[73] Assignee: Lexmark International, Inc., Lexington, Ky.

[21] Appl. No.: 09/338,952

[22] Filed: Jun. 24, 1999

[51] Int. Cl.[7] ..... B65H 31/20

[52] U.S. Cl. ..... 271/223; 271/220

[58] Field of Search ..... 271/220, 223, 271/224

[56] References Cited

U.S. PATENT DOCUMENTS

| | | | |
|---|---|---|---|
| 2,916,286 | 12/1959 | Keating . | |
| 3,658,323 | 4/1972 | Matwey | 271/223 |
| 3,918,701 | 11/1975 | Lee . | |
| 4,056,264 | 11/1977 | Dhooge et al. . | |
| 4,146,218 | 3/1979 | Loftus et al. . | |
| 4,682,770 | 7/1987 | Dempf et al. | 271/220 X |
| 4,721,229 | 1/1988 | Dempf et al. | 271/220 X |
| 4,903,956 | 2/1990 | Stephens et al. | 271/220 X |
| 5,152,513 | 10/1992 | Ogasawara et al. | 271/220 X |
| 5,618,038 | 4/1997 | Hutson | 271/220 X |

*Primary Examiner*—Christopher P. Ellis
*Assistant Examiner*—Patrick Mackey
*Attorney, Agent, or Firm*—John A. Brady

[57] ABSTRACT

A bail assembly has a first portion of an arm pivotally supported by a printer frame. A second portion of the arm is slidably supported by the first portion of the arm so that the length of the arm can be adjusted in accordance with the length of sheets being fed to a support for stacking. The second portion of the arm has a stop pivotally mounted on its distal end. The stop has a flange for engaging each of the fed sheets so that the leading edges of the sheets are in substantial vertical alignment. The first portion of the arm has notches, which are spaced apart the differences in the sizes of the sheets being fed, to receive a detent on the second portion of the arm to releasably hold the second portion of the arm in its adjusted position on the first portion of the arm. The second portion of the arm has two curved surfaces for engaging each fed sheet adjacent its leading edge in a transverse line point contact prior to the pivotally mounted stop engaging the leading edge of the fed sheet.

21 Claims, 7 Drawing Sheets

BAIL ASSEMBLY

FIELD OF THE INVENTION

This invention relates to a bail assembly for stopping fed sheets of a media and, more particularly, to a bail assembly in which leading edges of fed sheets are stacked in substantially vertical alignment by a pivotal stop.

BACKGROUND OF THE INVENTION

When feeding sheets of a media from a printer, for example, such as a laser printer or an ink jet printer, the sheets are fed from the printer to a sheet support such as a hopper or a tray, for example, on which they are to be stacked. The velocity of the fed sheets is sufficient to require a stopping arrangement so that the sheets are stacked with their leading edges substantially vertically aligned.

A previous stopping arrangement used a bail in which its free end rested on the uppermost sheet of media in the stack of sheets. This bail relied upon friction created by the free end of the bail engaging the sheet exiting from the printer to stop the fed sheet.

However, the bail did not function satisfactorily with some sheets of media. For example, the sheet being fed to a sheet support such as a hopper, for example, sometimes engaged the uppermost sheet in the stack in the hopper and pushed it beyond its normal stacked position in which the sheets would have their leading edges substantially vertically aligned. This produced a stack of sheets with a very ragged appearance because some of the sheets were pushed beyond the normal stack position.

Additionally, some of the sheets were occasionally ejected from the stack. This resulted in collations being lost from the stack of the sheets of media. This also caused the ejected sheet to be damaged or soiled, and a user would consider ejection of a sheet to be a failure of the product.

While a fixed stop for engaging each of the fed sheets at its leading edge would enable substantial vertical alignment of the leading edges of the sheets in the stack, the fixed stop has disadvantages. One disadvantage is that it presents an obstacle to removing the stack of sheets of media from the hopper or other support for the stack of sheets. Another disadvantage is that a fixed stop is not aesthetically appealing.

SUMMARY OF THE INVENTION

The bail assembly of the present invention satisfactorily solves the foregoing problem by having the leading edges of fed sheets substantially vertically aligned through stopping each fed sheet at a predetermined position. This is accomplished through providing a pivoted stop on the end of a pivotally mounted arm.

The arm is pivotally mounted on a horizontal pivot axis above the sheet support on which the sheets are supported in a stack so that the arm extends over the sheet support. The horizontal pivot axis of the arm is in substantial vertical alignment with the trailing edges of the stacked sheets to control the arm's center of gravity. This results in only a very light weight, which is preferably five grams or less, being applied to the stack of sheets.

The arm preferably has two curved surfaces, which have a width of less than one mm each, spaced from each other with each creating a transverse line point of contact with the fed sheet. Thus, each of the curved surfaces extends across a relatively small portion of the width of the fed sheet and contacts the fed sheet at only a point along a transverse line.

This substantially reduces the drag on the fed sheet. This is called a transverse line point contact in the claims.

Additionally, each of the stop, the arm, and a bracket for pivotally supporting the arm on the frame of the printer is formed of a very light weight material. Thus, the weight of the bail assembly is minimized.

Furthermore, the arm may have its length to permit the location of the stop to be shifted in accordance with the lengths of the fed sheets of media. Therefore, any length of the sheet may be accommodated by the bail assembly of the present invention.

An advantage of this invention is to provide an improved bail assembly for stopping fed sheets with their leading edges substantially vertically aligned to form a uniform stack of sheets.

Other advantages of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
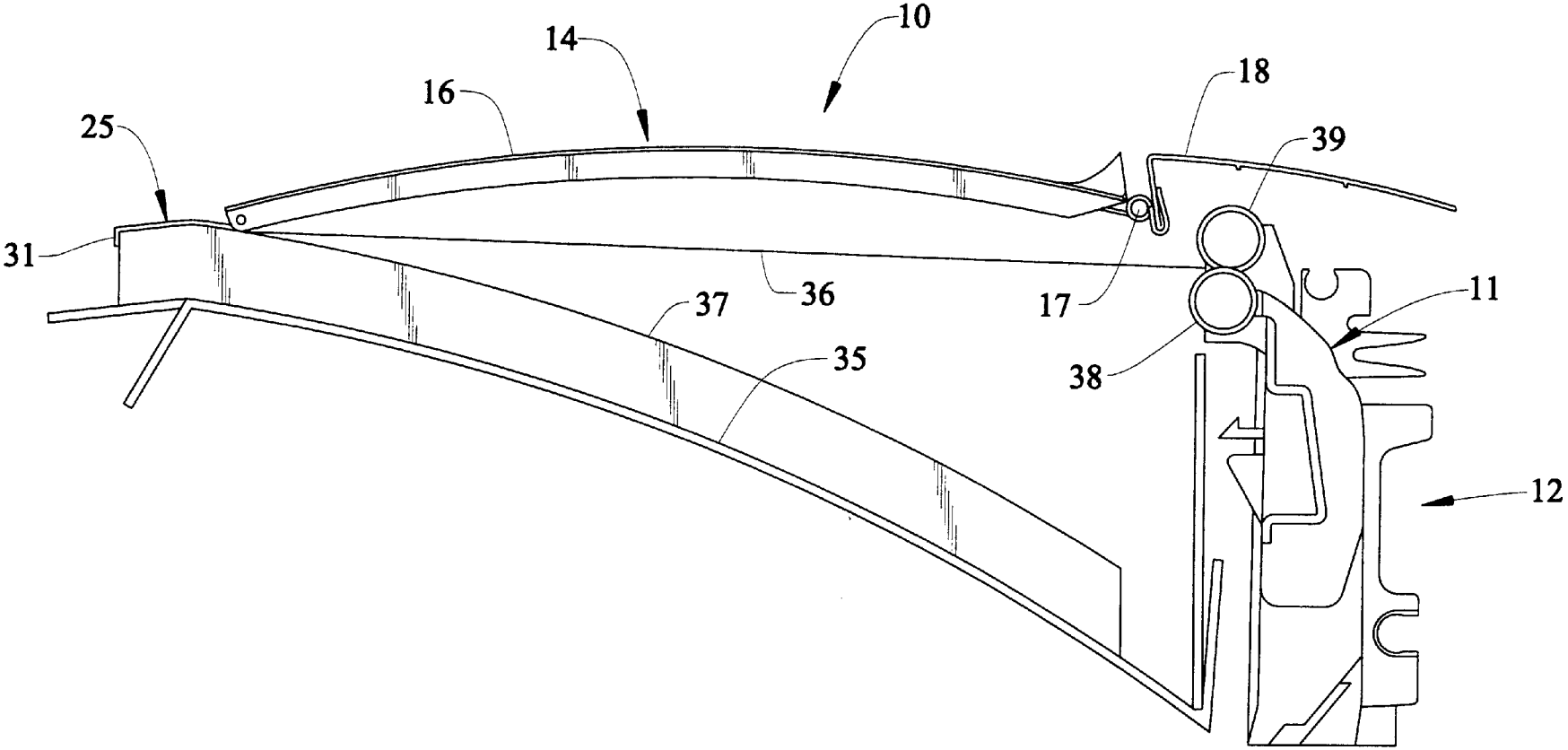
FIG. 1 is a schematic elevation view of the adjustable bail assembly of the present invention utilized with a printer.

Referring to the drawings and particularly FIG. 1, there is shown an adjustable bail assembly 10 pivotally supported by a frame 11 of a printer 12 such as a laser printer or an ink jet printer, for example. It should be understood that the adjustable bail assembly 10 may be employed with any other type of printer or other sheet feeding apparatuses such as a copier, for example.

The adjustable bail assembly 10 includes an arm 14. The arm 14 includes a pivoted first portion 15 (see FIG. 2) and a second portion 16 slidably supported on the first portion 15. One end of the first portion 15 has a pivot pin 17 integral therewith for pivotal support by a bracket 18.

The axis of the pivot pin 17 is substantially horizontal. The bracket 18 is fixed to the printer frame 11 (see FIG. 1).

Figure 2:
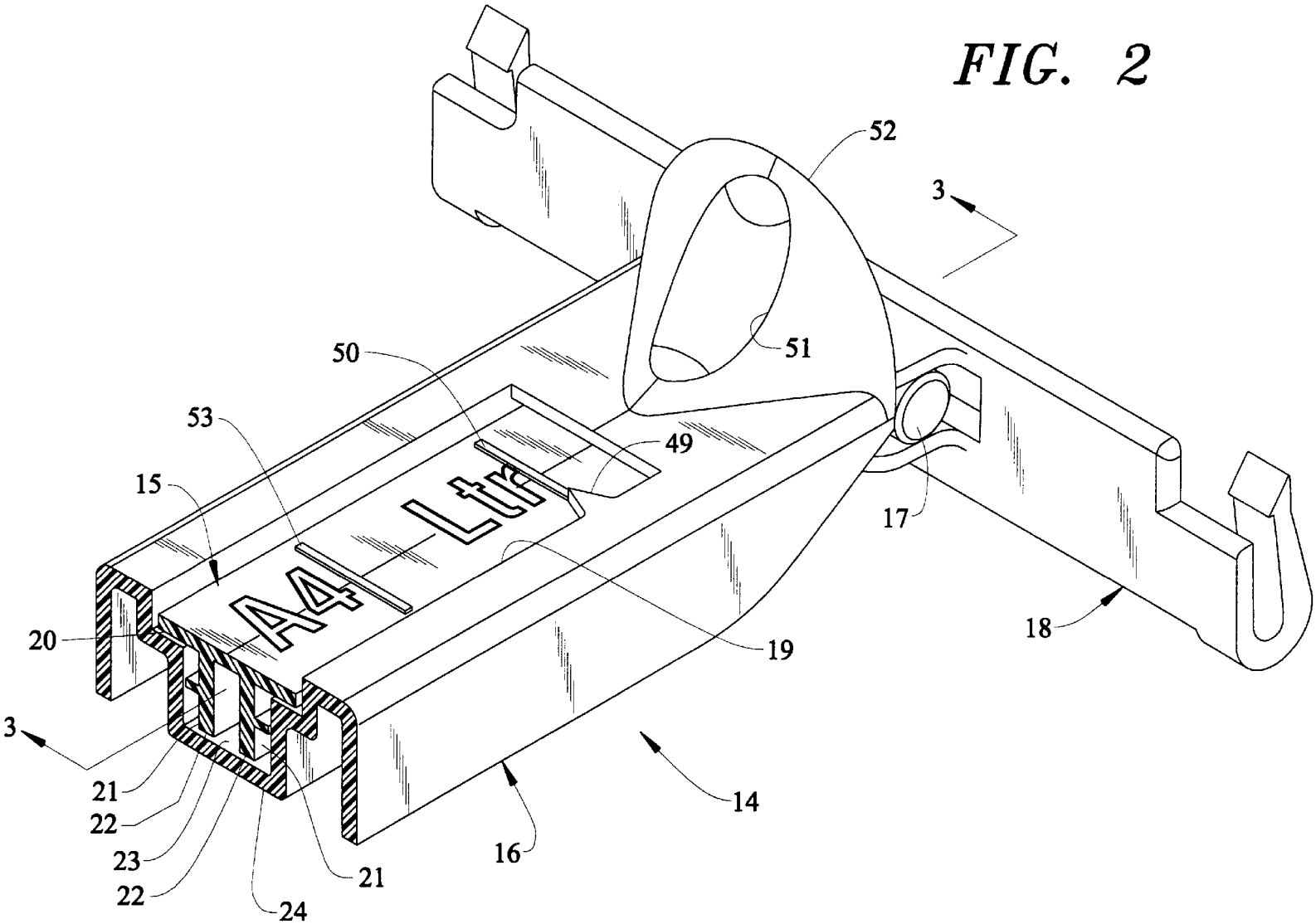
FIG. 2 is a perspective view, partly in section, of a portion of an adjustable arm of the bail assembly of FIG. 1.

As shown in FIG. 2, the second portion 16 of the arm 14 has a recess 19 within which the first portion 15 of the arm 14 is disposed. The first portion 15 has a planar portion 20 with a pair of fingers 21 extending downwardly therefrom. Each of the fingers 21 has a flat surface 22 slidable along a flat surface 23 of a bottom 24 of the second portion 16.

Figure 6:
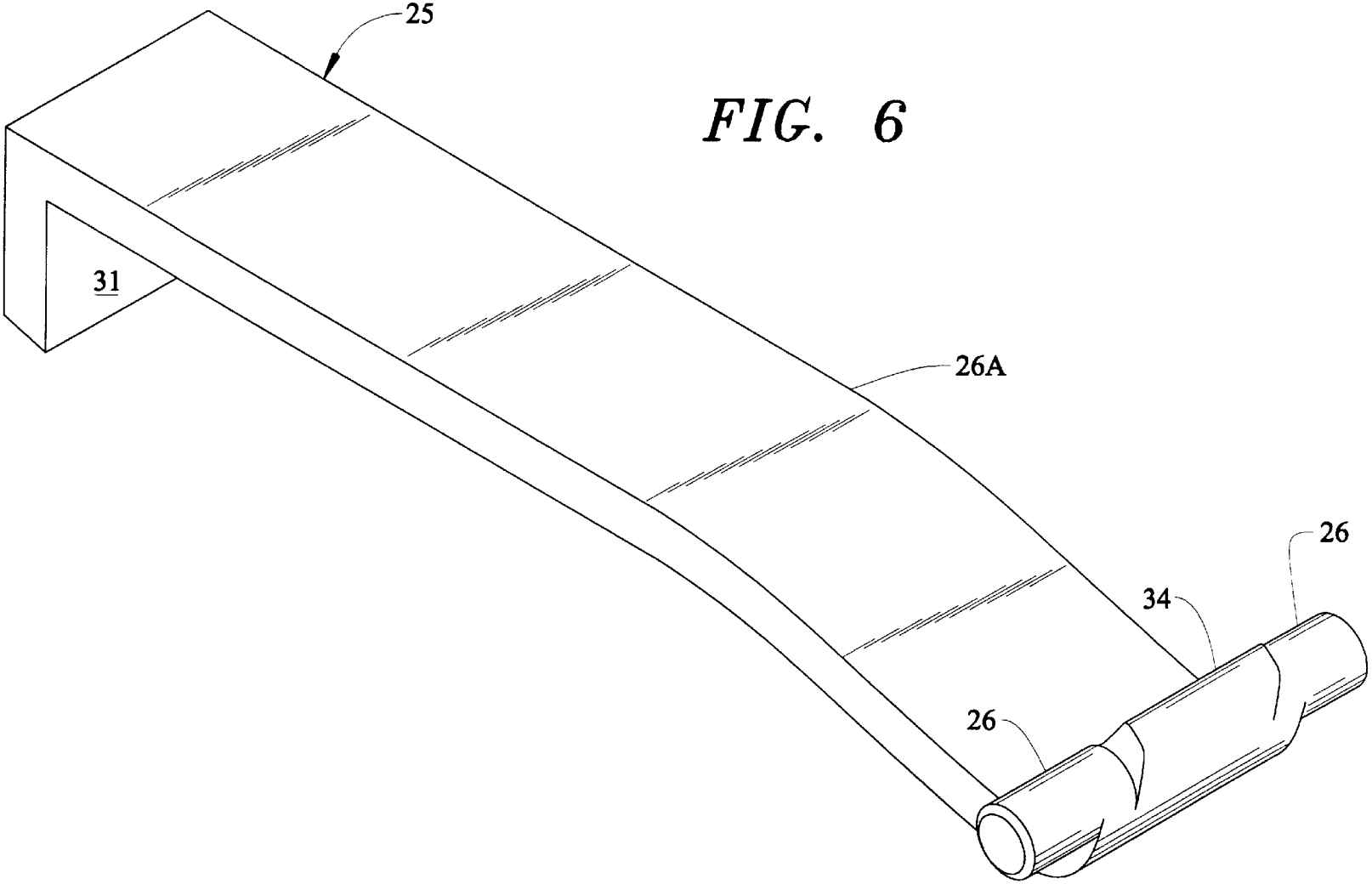
FIG. 6 is a perspective view of the pivotal stop.

The second portion 16 of the arm 14 has a stop 25 (see FIG. 1) pivotally mounted on its distal end. As shown in FIG. 6, the stop 25 has a pivot pin or post 26 extending from one end of a longitudinal portion 26A at opposite sides thereof.

Figure 4:
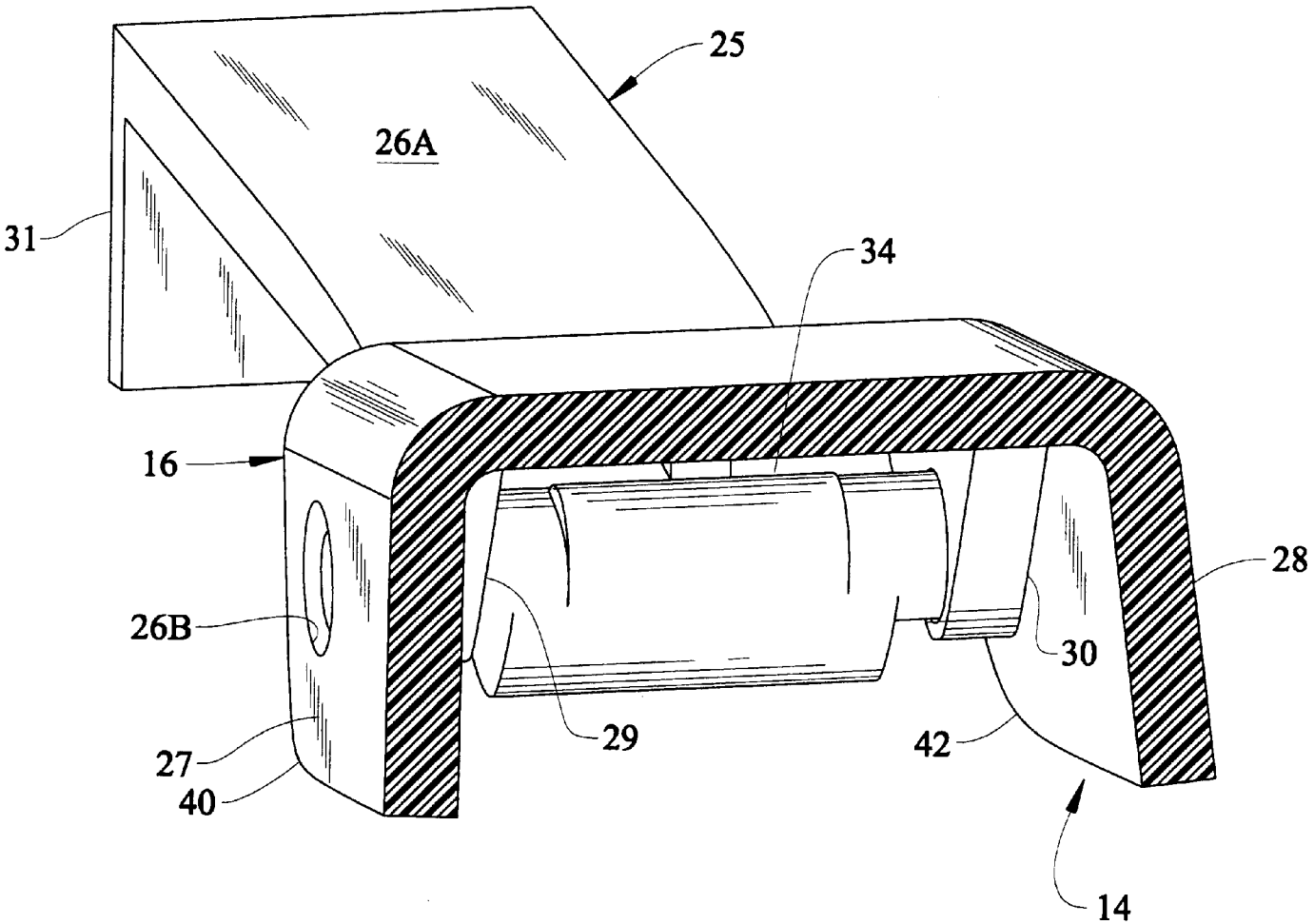
FIG. 4 is a perspective view, partly in section, of the second portion of the arm looking towards a stop pivotally mounted on the end of the second portion of the arm.
Figure 7:
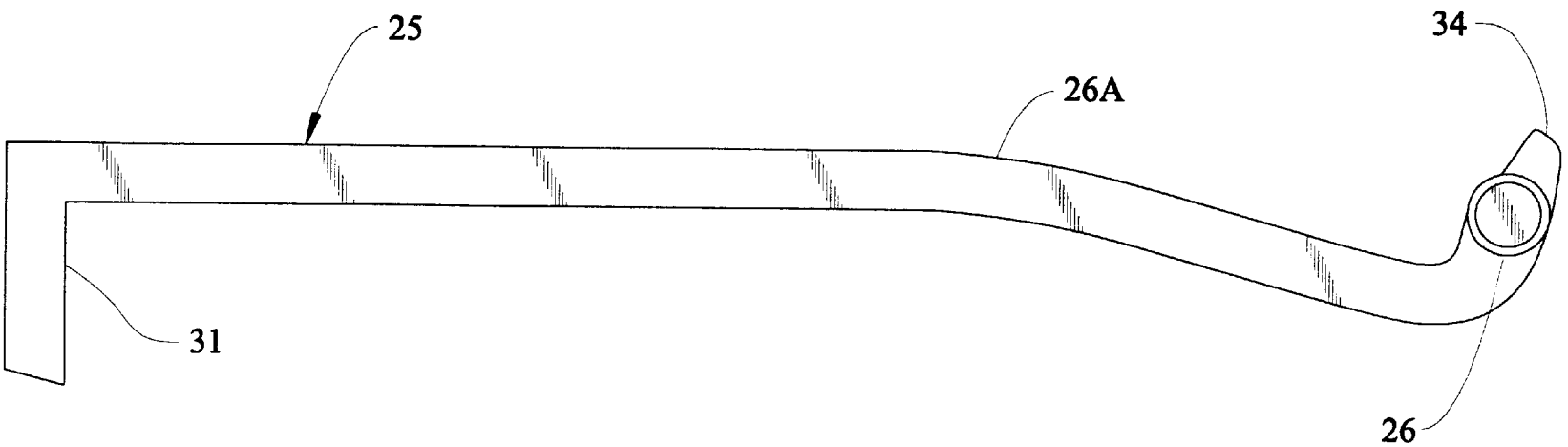
FIG. 7 is a side elevation view of the pivotal stop.

The pivot pin 26 has one end disposed in an opening 26B (see FIG. 4) in a side wall 27 of the second portion 16 of the arm 14. The pivot pin 26 has its other end disposed in an opening (not shown) in a side wall 28, which is substantially parallel to the side wall 27, of the second portion 16 of the arm 14. The pivot pin 26 also extends through an opening (not shown) in an ear 29 on the inner surface of the side wall 27 and an opening 29' (see FIG. 5) in an ear 30 on the inner surface of the side wall 28. The other end of the longitudinal portion 26A (see FIG. 4) of the stop 25 terminates in a flange 31. As shown in FIG. 7, the flange 31 is perpendicular to the longitudinal portion 26A.

Figure 5:
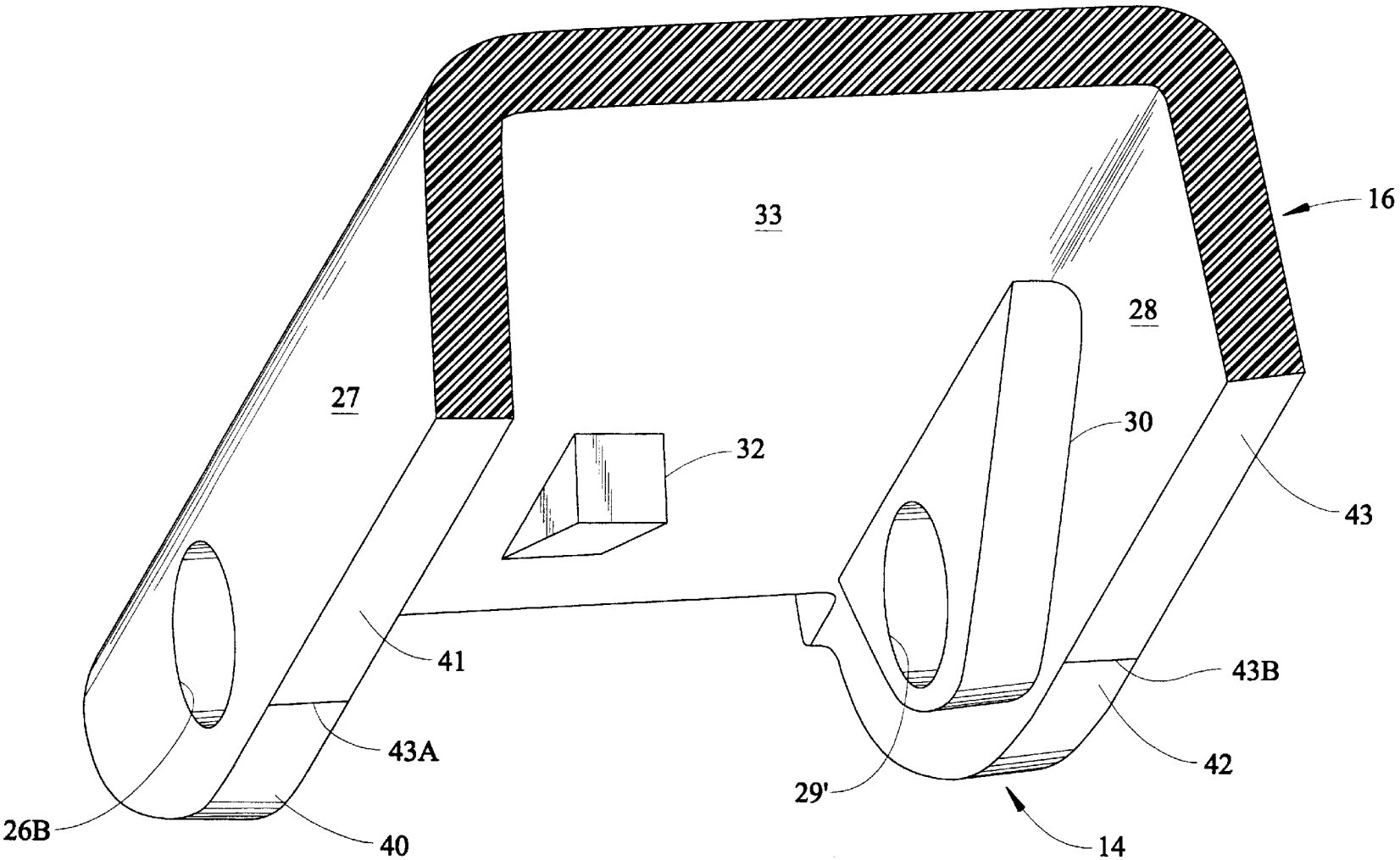
FIG. 5 is a perspective view, partly in section, of the second portion of the arm.

As shown in FIG. 5, the second portion 16 of the arm 14 has a stop 32 on its top wall 33 for engaging a raised portion 34 (sec FIG. 6) on the longitudinal portion 26A of the stop 25. This limits the rotation of the stop 25 about the axis of the pivot pin 26.

As shown in FIG. 1, the frame 11 of the printer 12 includes a sheet support surface 35 on which sheets 36 of a media are supported to form a stack 37. The sheet support surface 35 is curved although such is not a requisite for satisfactory operation.

The pivot pin 17 is in substantial vertical alignment with the trailing edge of each of the sheets 36 in the stack 37. This enables the weight of the arm 14 on the stack 37 of the sheets 36 to be relatively small such as five grams, for example. Each of the sheets 36 of media is fed from the printer 12 by a pair of feed rolls 38 and 39.

As shown in FIG. 5, the side wall 27 has curved surfaces 40 and 41, and the side wall has curved surfaces 42 and 43. The curved surface 40 curves upwardly towards the stop 25 (see FIG. 4) from an intersection 43A (see FIG. 5) of the two curved surfaces 40 and 41 while the curved surface 41 curves slightly upwardly towards the first portion 15 (see FIG. 2) of the arm 14. Similarly, the curved surface 42 (see FIG. 5) curves upwardly towards the stop 25 (see FIG. 4) from an intersection 43B (see FIG. 5) of the two curved surfaces 42 and 43 while the curved surface 43 curves slightly upwardly towards the first portion 15 (see FIG. 2) of the arm 14.

As each of the sheets 36 (see FIG. 1) of media is fed from the printer 12 by the feed rolls 38 and 39, the fed sheet 36 has portions of its top surface adjacent its leading edge contacting the curved surfaces 40 (see FIG. 4) and 42 of the side walls 27 and 28, respectively, of the second portion 16 of the arm 14. Accordingly, the curved surfaces 40 and 42 make the initial contact with the top surface of the fed sheet 36 (see FIG. 1) as its leading edge passes the curved surfaces 40 (see FIG. 4) and 42 of the side walls 27 and 28, respectively, of the second portion 16 of the arm 14.

The contact of each of the curved surfaces 40 and 42 of the side walls 27 and 28, respectively, of the second portion 16 of the arm 14 is a transverse line point contact. That is, the width, which is less than 1 mm, of each of the curved surfaces 40 and 42 contacts the top surface of the fed sheet 36 (see FIG. 1) but only at a point on the fed sheet 36 at any time along the entire width of each of the curved surfaces 40 (see FIG. 4) and 42.

As the feed rolls 38 (see FIG. 1) and 39 continue to feed the uppermost sheet 36, its leading edge is slightly spaced from the flange 31 of the stop 25. The uppermost sheet 36 moves into engagement with the flange 31 of the stop 25 by friction from the next sheet 36 being advanced by the feed rolls 38 and 39. This positions the leading edges of the stacked sheets 36 in substantial vertical alignment as shown in FIG. 1.

Figure 3:
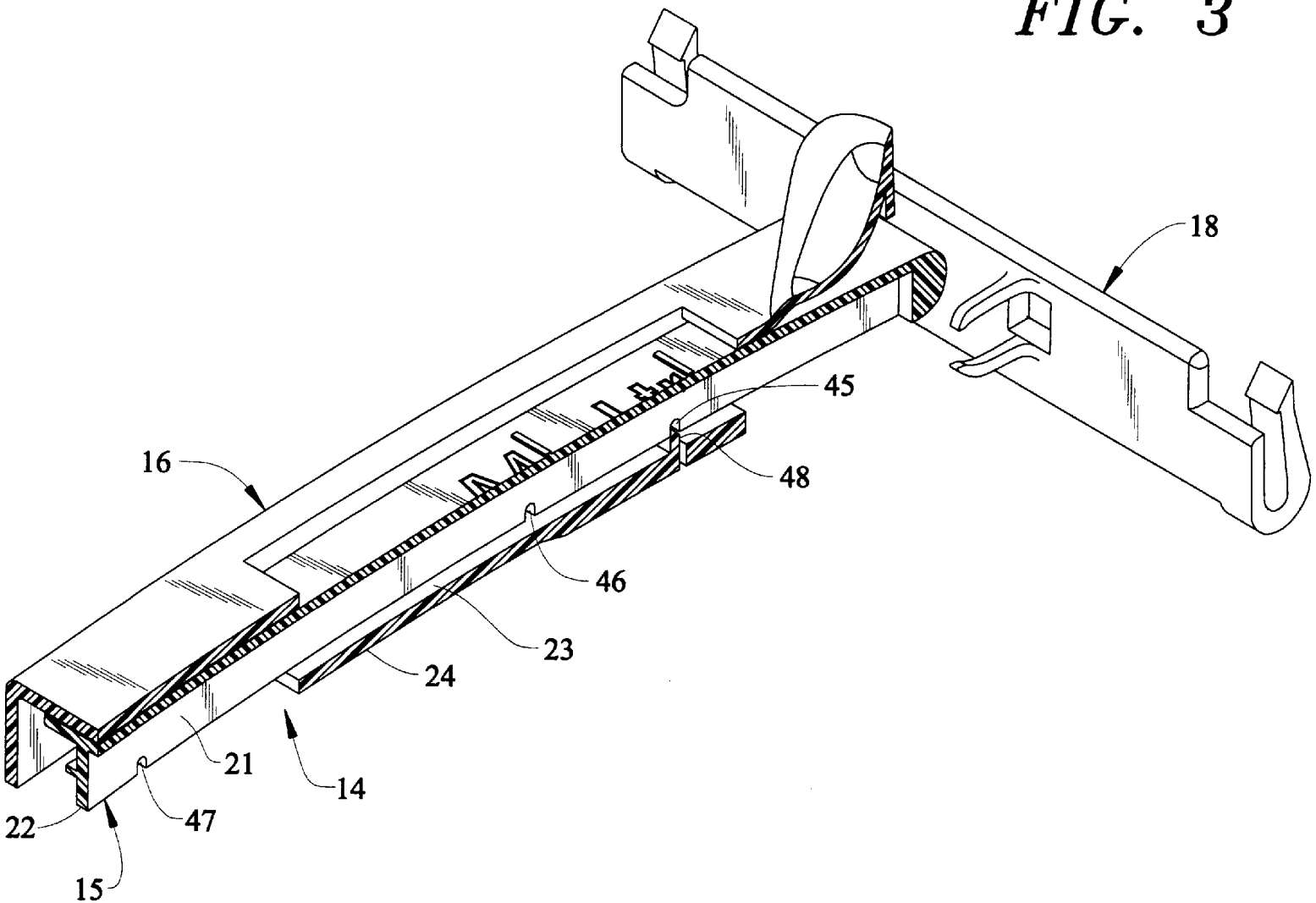
FIG. 3 is a perspective view, partly in section, of the arm showing the arrangement for releasably holding the first and second portions and taken along line 3—3 of FIG. 2.

As shown in FIG. 3, the flat surface 22 of one of the fingers 21 of the first portion 15 of the arm 14 has three notches 45, 46, and 47 formed therein. A detent 48 is mounted on the flat surface 23 of the bottom 24 of the second portion 16 of the arm 14 adjacent its end closest to the bracket 18 for engagement with one of the three notches 45–47 to releasably hold the portions 15 and 16 at the desired length of the arm 14.

When the sheets 36 (see FIG. 1) are letter size, the notch 45 (see FIG. 3) has the detent 48 therein. As shown in FIG. 2, the second portion 16 of the arm 14 has a pointer 49 for alignment with a raised linear portion 50 on the planar portion 20 of the first portion 15 of the arm 14. This indicates that the arm 14 has the desired length when the sheets 36 (see FIG. 1) are letter size.

When the sheets 36 are A4 size, the detent 48 (see FIG. 3) is moved out of engagement with the notch 45 and into engagement with the notch 46. This is accomplished by a user placing a thumb in a shallow recess 51 (see FIG. 2) in a raised portion 52 of the second portion 16 of the arm 14. Movement of the second portion 16 of the arm 14 to the left in FIG. 3 with the detent 48 moved out of the notch 45 results in the detent 48 moving into the notch 46.

The distance between the notches 45 and 46 is equal to the difference in the lengths between letter size and A4 size paper. When the detent 48 is in the notch 46, the pointer 49 is aligned with a raised linear portion 52 (see FIG. 2) on the first portion 15 of the arm 14 to indicate that the arm 14 has the desired length when the sheets 36 (see FIG. 1) are A4 size.

When legal size paper is used, the detent 48 (see FIG. 3) on the flat surface 23 of the bottom 24 of the second portion 16 of the arm 14 is moved out of the notch 46 and to the left in FIG. 3 until the detent 48 enters the notch 47. The pointer 49 (see FIG. 2) is aligned with another raised linear portion (not shown) on the first portion 15 of the arm 14 to indicate that the sheets 36 (see FIG. 1) are legal size. The distance between the notches 46 (see FIG. 3) and 47 is equal to the difference in the lengths of A4 and legal size paper.

Each of the first portion 15 of the arm 14, the second portion 16 of the arm 14, and the stop 25 (see FIG. 1) is formed of a light weight plastic. The light weight plastic is preferably acrylonitrile butadiene styrene (ABS) sold under the trademark CYCOLAC T by General Electric.

While the detent 48 (see FIG. 3) and the notches 45–47 have been shown and described as cooperating with each other to releasably hold the second portion 16 of the arm 14 in the desired position on the first portion 15 of the arm 14, it should be understood that any other suitable releasably holding means may be employed.

While the two curved surfaces 40 (see FIG. 5) and 42 have been shown and described as contacting each of the fed sheets 36 (see FIG. 1), it should be understood that such is not necessary for satisfactory operation. Only one curved surface could be employed or more than two, if desired.

An advantage of this invention is that it prevents sheets from being pushed past the sheets in a stack. Another advantage of this invention is that it prevents ejection of one or more sheets from a stack of sheets. A further advantage of this invention is that it is easy to remove the stacked sheets from their support since there is no obstacle of a fixed stop to prevent their removal. Still another advantage of this invention is that it is to different sizes of sheets to be stacked. A still further advantage of this invention is that it minimizes weight and drag on the fed sheet.

For purposes of exemplification, a preferred embodiment of the invention have been shown and described according to the best present understanding thereof. However, it will be apparent that changes and modifications in the arrangement and construction of the parts thereof may be resorted to without departing from the spirit and scope of the invention.

What is claimed is:

1. A bail assembly for stopping each fed sheet of a media in which the sheets are to be stacked on a sheet support so that the sheets have their leading edges substantially vertically aligned including:

an arm having one end pivotally supported above the horizontal plane of the sheet support and extending over at least the area of the sheet support having the sheets supported thereon;

said arm having contact means adjacent its distal end for making at least one initial transverse line point contact with the top surface of each of the fed sheets; and a stop pivotally supported by said arm adjacent the distal end for engaging a leading edge of each of the fed sheets after said contact means makes the at least one initial transverse line point contact with the top surface of the feed sheet, said stop resting on top of the fed sheets to stop each of the sheets to form the stack with the leading edges of the fed sheets substantially vertically aligned;

said bail assembly having no obstruction preventing the leading edge of individual sheets from moving past said contact means.

2. The bail assembly according to claim 1 in which said arm includes:

a first portion having one end pivotally supported above the sheet support with its pivot axis in substantial vertical alignment with the trailing edges of the stacked sheets;

a second portion slidably supported by said first support portion to change the length of said arm in accordance with the dimension of the sheets to be stacked in their fed direction;

said second portion of said arm including said contact means for contacting the top surface of each of the fed sheets;

and said second portion of said arm having pivotal mounting means pivotally mounted on its end distal from said first portion for pivotally mounting said stop on said second portion.

3. The bail assembly according to claim 1 in which said contact means includes at least one curved surface on said arm having only a transverse line point contact with the top surface of the fed sheet across the width of said at least one curved surface, the width of said at least one curved surface is relatively small in comparison with the width of the fed sheets.

4. The bail assembly according to claim 2 in which said contact means includes at least one curved surface on said second portion of said arm having only a transverse line point contact with the top surface of the fed sheet across the width of said at least one curved surface, the width of said at least one curved surface is relatively small in comparison with the width of the fed sheets.

5. The bail assembly according to claim 4 including releasable holding means for releasably holding said second portion of said arm in various predetermined positions on said first portion of said arm to change the length of said arm in accordance with the dimension of the sheets to be stacked in their fed direction.

6. The bail assembly according to claim 5 in which said releasable holding means includes cooperating means on each of said first and second portions of said arm for releasably engaging each other.

7. The bail assembly according to claim 6 in which:

said cooperating means on said first portion of said arm is integral with said first portion of said arm to form a single piece;

and said cooperating means on said second portion of said arm is integral with said second portion of said arm to form a single piece.

8. The bail assembly according to claim 7 in which:

said cooperating means on said first portion of said arm comprises a plurality of notches in said first portion of said arm and spaced from each other in accordance with the differences in the dimensions of the sheets to be stacked in their fed direction;

and said cooperating means on said second portion of said arm comprises a detent on said second portion of said arm for disposition in one of said notches in said first portion of said arm in accordance with the dimension of the sheets to be stacked in their fed direction as said second portion of said arm is slidably moved relative to said first portion of said arm.

9. The bail assembly according to claim 8 in which each of said first portion of said arm, said second portion of said arm, and said stop is formed of a light weight plastic.

10. The bail assembly according to claim 7 in which each of said first portion of said arm, said second portion of said arm, and said stop is formed of a light weight plastic.

11. The bail assembly according to claim 6 in which each of said first portion of said arm, said second portion of said arm, and said stop is formed of a light weight plastic.

12. The bail assembly according to claim 5 in which each of said first portion of said arm, said second portion of said arm, and said stop is formed of a light weight plastic.

13. The bail assembly according to claim 4 in which each of said first portion of said arm, said second portion of said arm, and said stop is formed of a light weight plastic.

14. The bail assembly according to claim 1 in which:

said contact means includes a plurality of curved surfaces on said arm and spaced from each other in a direction substantially perpendicular to the feed direction of the sheets;

and each of said curved surfaces has only a transverse line point contact with the top surface of the fed sheet across the width of each of said curved surfaces, the width of each of said curved surfaces is relatively small in comparison with the width of the fed sheets.

15. The bail assembly according to claim 2 in which:

said contact means includes a plurality of curved surfaces on said second portion of said arm and spaced from each other in a direction substantially perpendicular to the feed direction of the sheets;

and each of said curved surfaces has only a transverse line point contact with the top surface of the fed sheet across the width of each of said curved surfaces, the width of each of said curved surfaces is relatively small in comparison with the width of the fed sheets.

16. The bail assembly according to claim 15 including releasable holding means for releasably holding said second portion of said arm in various predetermined positions on said first portion of said arm to change the length of said arm in accordance with the dimension of the sheets to be stacked in their fed direction.

17. The bail assembly according to claim 16 in which said releasable holding means includes cooperating means on each of said first and second portions of said arm for releasably engaging each other.

18. The bail assembly according to claim 17 in which:

said cooperating means on said first portion of said arm is integral with said first portion of said arm to form a single piece;

and said cooperating means on said second portion of said arm is integral with said second portion of said arm to form a single piece.

19. The bail assembly according to claim 18 in which:

said cooperating means on said first portion of said arm comprises a plurality of notches in said first portion of said arm and spaced from each other in accordance with the differences in the dimensions of the sheets to be stacked in their fed direction;

and said cooperating means on said second portion of said arm comprises a detent on said second portion of said arm for disposition in one of said notches in said first portion of said arm in accordance with the dimension of the sheets to be stacked in their fed direction as said second portion of said arm is slidably moved relative to said first portion of said arm.

20. The bail assembly according to claim 19 in which each of said first portion of said arm, said second portion of said arm, and said stop is formed of a light weight plastic.

21. The bail assembly according to claim 15 in which each of said first portion of said arm, said second portion of said arm, and said stop is formed of a light weight plastic.

* * * * *